US007367151B1

(12) United States Patent
Black et al.

(10) Patent No.: US 7,367,151 B1
(45) Date of Patent: May 6, 2008

(54) GUN BORE CLEANING SYSTEM

(75) Inventors: Wesley F. Black, Williston, ND (US); Charles D. Black, Williston, ND (US); Robert J. Black, Williston, ND (US)

(73) Assignee: New Producst Marketing Corporation, Williston, ND (US)

( * ) Notice: Subject to any disclaimer, the term of this patent is extended or adjusted under 35 U.S.C. 154(b) by 245 days.

(21) Appl. No.: 11/219,093

(22) Filed: Sep. 1, 2005

Related U.S. Application Data

(63) Continuation-in-part of application No. 11/132,692, filed on May 18, 2005.

(60) Provisional application No. 60/646,403, filed on Jan. 21, 2005, provisional application No. 60/607,203, filed on Sep. 2, 2004.

(51) Int. Cl.
*F41A 29/00* (2006.01)

(52) U.S. Cl. ..... 42/95; 42/90; 15/104.067; 15/104.05

(58) Field of Classification Search ..... 42/95, 42/90; 15/104.067, 104.05
See application file for complete search history.

(56) References Cited

U.S. PATENT DOCUMENTS

| | | | | |
|---|---|---|---|---|
| 514,514 | A * | 2/1894 | Stafford | 15/104.05 |
| 2,536,185 | A * | 1/1951 | Johnson | 15/104.067 |
| 4,873,778 | A * | 10/1989 | Stipp | 42/95 |
| 5,588,242 | A * | 12/1996 | Hughes | 42/95 |
| 6,088,866 | A * | 7/2000 | Hedge | 15/104.16 |
| 6,630,034 | B1 * | 10/2003 | Schnell | 134/8 |
| 7,131,381 | B1 * | 11/2006 | Nafziger | 102/444 |

* cited by examiner

*Primary Examiner*—John W Eldred
(74) *Attorney, Agent, or Firm*—Michael S. Neustel

(57) ABSTRACT

A gun bore cleaning system for efficiently cleaning a bore of a gun. The gun bore cleaning system includes a cleaning member having a spiral groove and a length of cord positionable within the spiral groove. The cord is extended through a bore of a gun with the cleaning member cleaning the bore of the gun.

11 Claims, 16 Drawing Sheets

GUN BORE CLEANING SYSTEM

CROSS REFERENCE TO RELATED APPLICATIONS

I hereby claim benefit under Title 35, United States Code, Section 120 of U.S. patent application Ser. No. 11/132,692 filed May 18, 2005, and under Title 35, United States Code, Section 119(e) of U.S. provisional patent application Ser. No. 60/646,403 filed Jan. 21, 2005 and Ser. No. 60/607,203 filed Sep. 2, 2004. Ser. No. 11/132,692 claims priority from Ser. No. 60/646,403 and 60/607,203. The Ser. Nos. 11/132,692, 60/646,403 and 60/607,203 applications are currently pending. The Ser. No. 11/132,692, 60/646,403 and 60/607,203 applications are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to gun bore cleaning devices and more specifically it relates to a gun bore cleaning system for efficiently cleaning a bore of a gun.

2. Description of the Related Art

Any discussion of the prior art throughout the specification should in no way be considered as an admission that such prior art is widely known or forms part of common general knowledge in the field.

Gun bore cleaning devices have been in use for years. Conventional gun bore cleaning devices are typically comprised of a plurality of bristles (e.g. bronze, copper, nylon) threadably attached to a relatively rigid cleaning rod. A shaft is then attached to an end of the cleaning rod for allowing a user to reciprocate the bristles within the gun bore.

One problem with conventional gun bore cleaning devices is that they require a considerable amount of time to assemble. Another problem with conventional gun bore cleaning devices is that they are relatively expensive for consumers to purchase. Another problem with conventional gun bore cleaning devices is that they must be cleaned prior to storage. A further problem with conventional gun bore cleaning devices is that they must be stored when not in use. Another problem with conventional gun bore cleaning devices is that they are not readily disposable.

While these devices may be suitable for the particular purpose to which they address, they are not as suitable for efficiently cleaning a bore of a gun. Conventional gun bore cleaning devices are relatively expensive, time consuming to utilize, require cleaning, and are not easily stored.

In these respects, the gun bore cleaning system according to the present invention substantially departs from the conventional concepts and designs of the prior art, and in so doing provides an apparatus primarily developed for the purpose of efficiently cleaning a bore of a gun.

BRIEF SUMMARY OF THE INVENTION

In view of the foregoing disadvantages inherent in the known types of gun bore cleaning devices now present in the prior art, the present invention provides a new gun bore cleaning system construction wherein the same can be utilized for efficiently cleaning a bore of a gun.

The general purpose of the present invention, which will be described subsequently in greater detail, is to provide a new gun bore cleaning system that has many of the advantages of the gun bore cleaning devices mentioned heretofore and many novel features that result in a new gun bore cleaning system which is not anticipated, rendered obvious, suggested, or even implied by any of the prior art gun bore cleaning devices, either alone or in any combination thereof.

To attain this, the present invention generally comprises a cleaning member having a spiral groove and a length of cord positionable within the spiral groove. The cord is extended through a bore of a gun with the cleaning member cleaning the bore of the gun.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a gun bore cleaning system that will overcome the shortcomings of the prior art devices.

A second object is to provide a gun bore cleaning system for efficiently cleaning a bore of a gun.

Another object is to provide a gun bore cleaning system that does not require assembly.

An additional object is to provide a gun bore cleaning system that is relatively inexpensive.

A further object is to provide a gun bore cleaning system that is disposable or non-disposable.

Another object is to provide a gun bore cleaning system that does not require cleaning.

A further object is to provide a gun bore cleaning system that may be conveniently stored in a relatively small area.

Another object is to provide a gun bore cleaning system that does not require a user to directly contact a contaminated swab.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
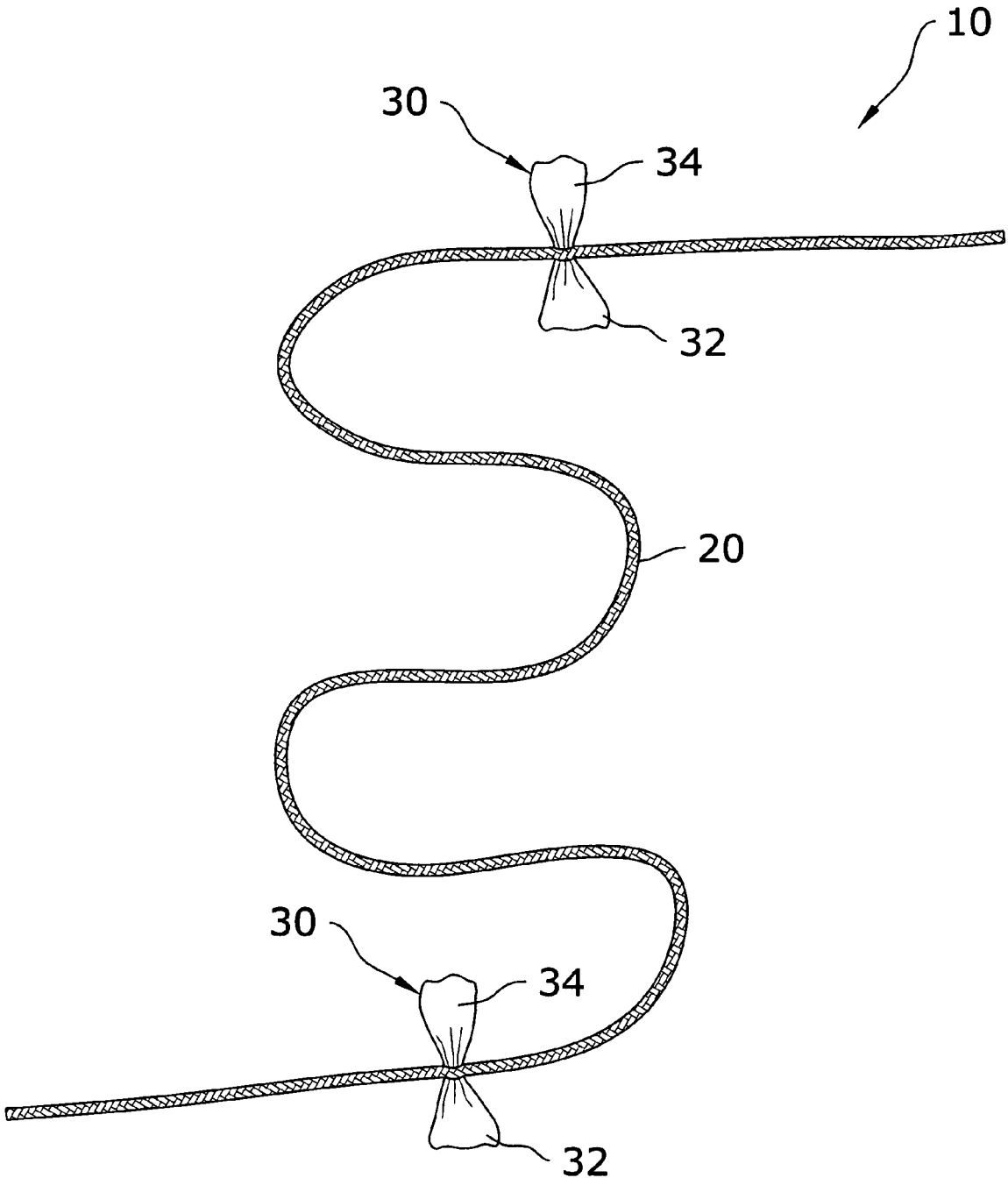
FIG. 1 is an upper perspective view of the present invention.

Turning now descriptively to the drawings, in which similar reference characters denote similar elements throughout the several views, FIGS. 1 through 21 illustrate a gun bore cleaning system 10, which comprises a cord 20 having a plurality of receiver openings 22 for removably receiving a corresponding plurality of swabs 30. The cord 20 is extendable into the bore 16 of a gun 12 for cleaning the bore 16. A brush 40 may also be removably attached to the cord 20, wherein the brush 40 has a plurality of radially extending bristles 42. The swabs 30 and the brush 40 may also be non-removably attached to the cord 20.

B. Cord

Figure 6:
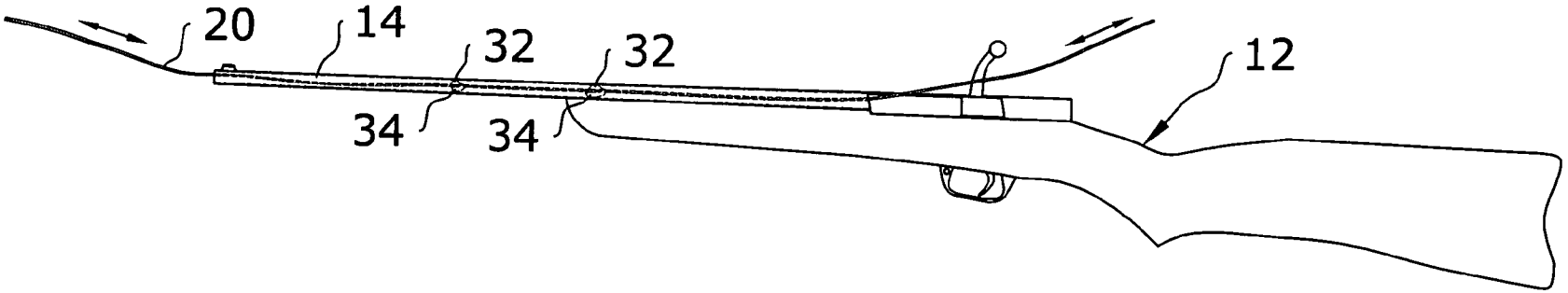
FIG. 6 is a side view of the present invention being utilized within a barrel of a gun.
Figure 7:
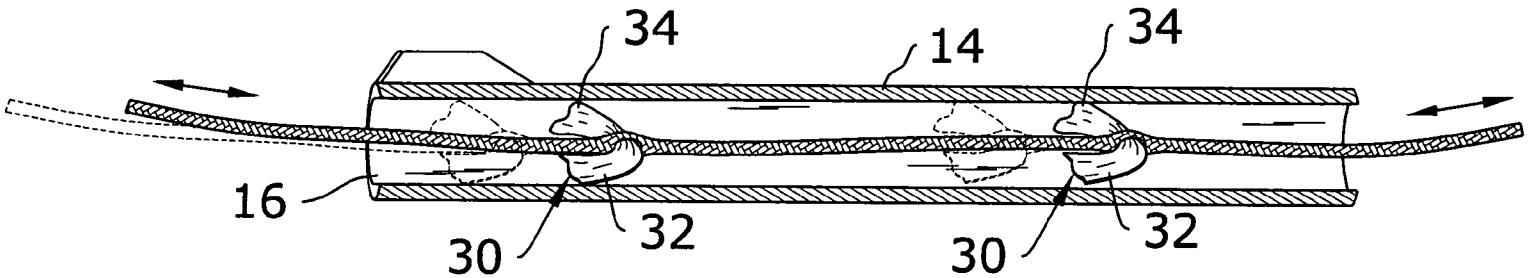
FIG. 7 is a side cutaway view of the present invention positioned within a bore of a gun.
Figure 10:
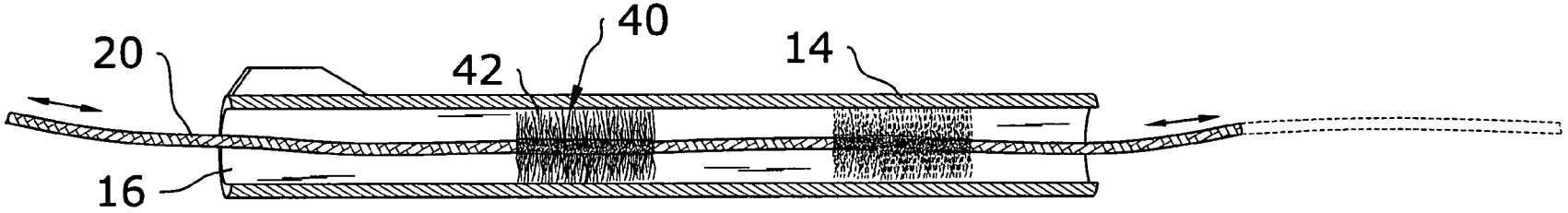
FIG. 10 is a side cutaway view of the alternative embodiment utilized within a bore of a barrel.

The cord 20 is comprised of an elongated flexible structure having a first end and a second end. The length of the cord 20 is sufficient to pass the first end completely through one end of the barrel 14 with the second end extended outside of the opposite end of the barrel 14 as shown in FIG. 6 of the drawings. The length of the cord 20 may be sufficient to allow for the severing of portions of the cord 20 as they become used and contaminated. The cord 20 has a width narrower than the bore 16 of the barrel 14 as illustrated in FIGS. 7 and 10 of the drawings. The cord 20 may be comprised of any material or structure that is flexible (e.g. natural or manmade fibers twisted or braided together).

The cord 20 includes at least one receiver opening 22 removably receiving the at least one swab 30. It is preferable that the cord 20 include a plurality of receiver openings 22 for receiving a corresponding plurality of swabs 30 as illustrated in FIG. 1 of the drawings.

Figure 2:
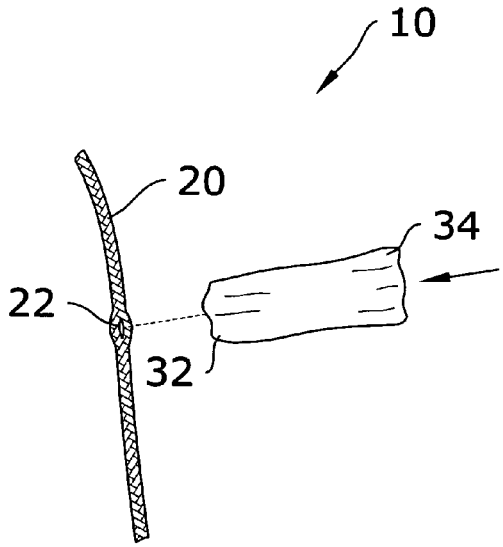
FIG. 2 is an exploded upper perspective view of a swab with respect to a receiver opening in the cord.

FIG. 2 illustrates a receiver opening 22 within the cord 20 for receiving a corresponding swab 30. It is preferable that a plurality of receiver openings 22 be utilized for receiving a corresponding plurality of swabs 30. The receiver openings 22 are preferably sized so as to snugly receive and retain the swabs 30 while allowing for the insertion and removal of the swabs 30. The swabs 30 are removable from and insertable into the receiver openings 22 of the cord 20 for allowing replacement of contaminated swabs 30. Alternatively, the swabs 30 may be permanently attached to the cord 20 via various attachment methods.

Figure 11:
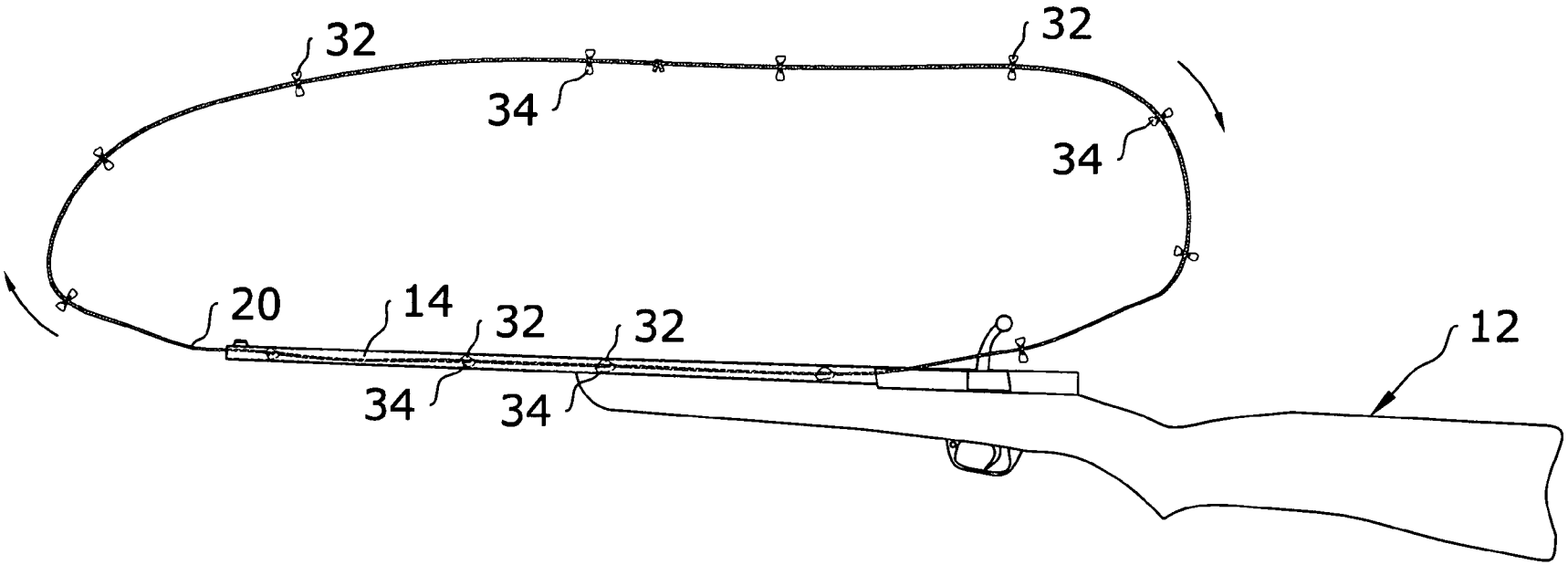
FIG. 11 is a side view of the present invention with the distal ends of the cord tied together forming a loop structure.
Figure 12:
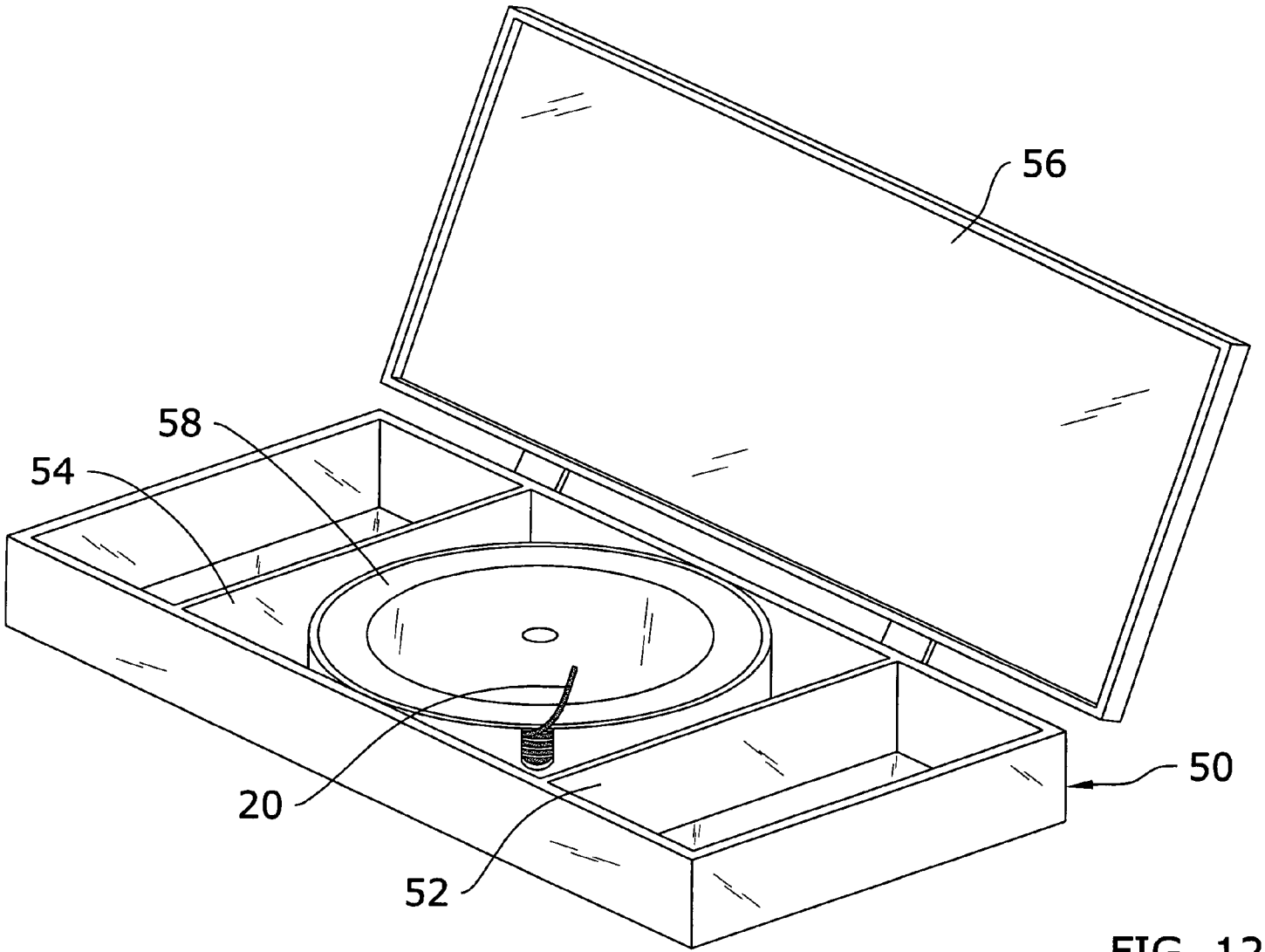
FIG. 12 is an upper perspective view of a housing structure capable of storing and dispensing the present invention.

In addition, the distal ends of the cord 20 may be tied together forming a loop structure as illustrated in FIG. 11 of the drawings. The loop structure for the cord 20 allows the user to move the cord 20 with the swabs 30 in a single direction away from the action parts of the gun 12. This prevents debris from falling into the action parts of the gun 12 during cleaning which can occur with conventional cleaning devices.

C. Swab

Figure 4:
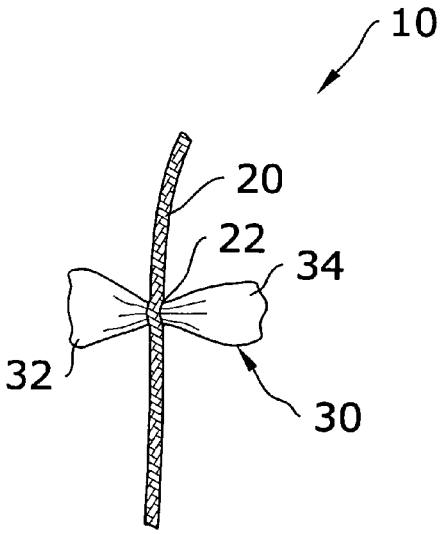
FIG. 4 is an upper perspective view of the swab fully inserted into the receiver opening in the cord.
Figure 5:
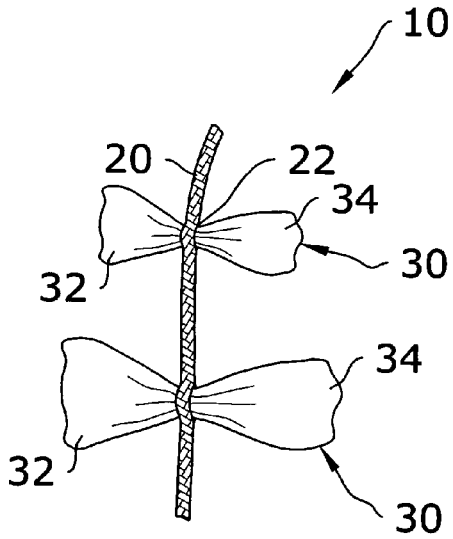
FIG. 5 is an upper perspective view of two swabs positioned within the cord having different sizes.

The swab 30 is attached to the cord 20 between the first end and the second end as shown in FIG. 1 of the drawings. The swab 30 has a first portion 32 and a second portion 34 extending on opposite sides of the cord 20 as best illustrated in FIGS. 4 and 5 of the drawings. It is preferable that a plurality of swabs 30 be attached to the cord 20.

The swab 30 is preferably comprised of a cloth material (e.g. natural or manmade textile fiber). The swab 30 may be comprised of various sizes, shapes and structures. The swab 30 is preferably comprised of a substantially flat structure prior to attachment to the cord 20 as shown in FIG. 2 of the drawings. However, various other structures may be utilized to construct the swab 30. The swab 30 is capable of receiving a volume of cleaning solvent or oil. As the swab 30 passes through the bore 16 of the barrel 14, the swab 30 both cleans and dries the inner wall of the bore 16.

The swabs 30 are preferably approximately four inches apart on the cord 20. The swabs 30 are preferably positioned in groups of 2 or more within approximately a six foot section to allow the user to sever the six foot section for cleaning a gun 12.

Figure 13:
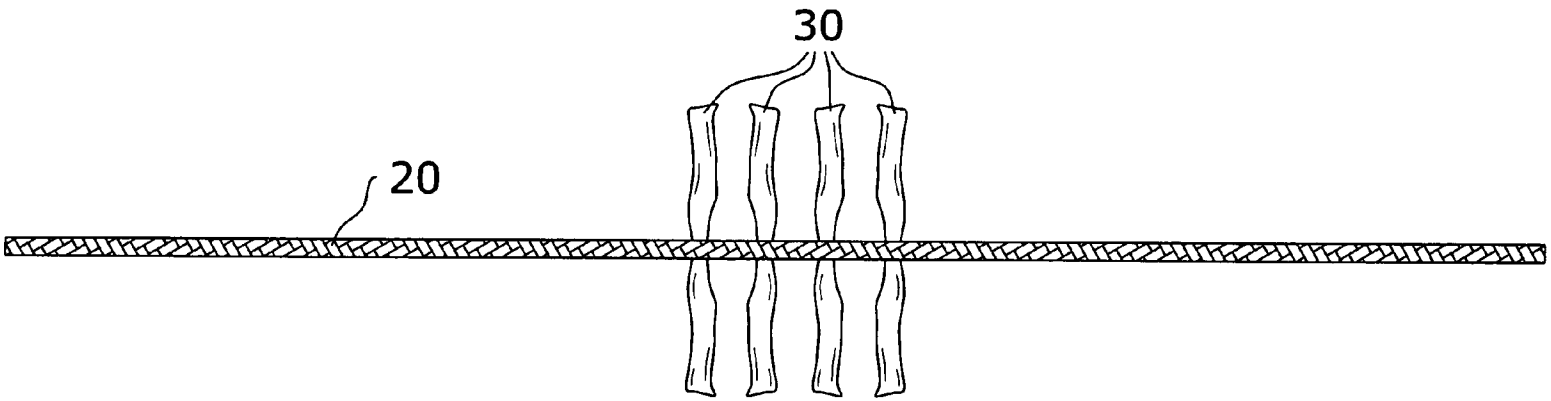
FIG. 13 is a side view of the present invention with the swabs closely positioned together to create an increased effective diameter for cleaning larger diameter bores.
Figure 14:
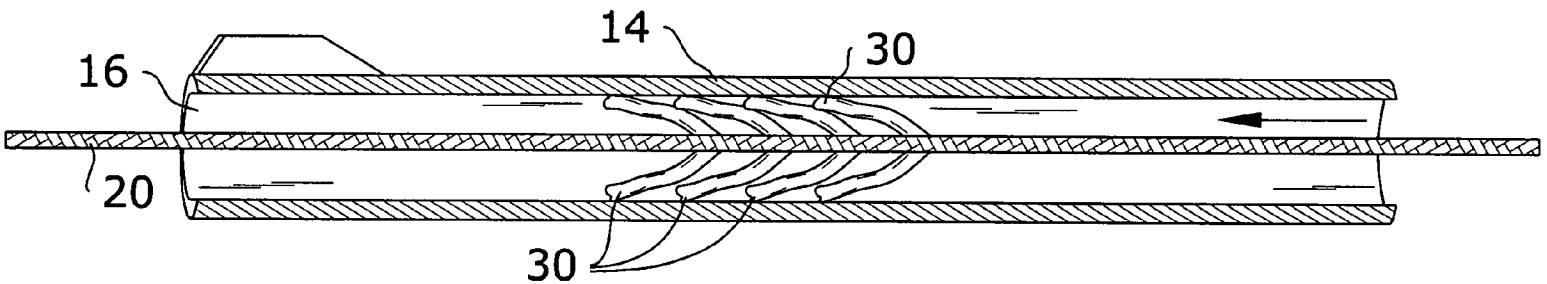
FIG. 14 is a side cutaway view illustrating the structure shown in FIG. 13 in use within a larger bore.

FIGS. 13 and 14 also illustrate an alternative embodiment where the swabs 30 are closely positioned together to effectively increase the cleaning diameter. The alternative embodiment for the present invention allows for the cleaning of bores having a larger diameter by utilizing relatively thin swabs 30.

D. Brush

Figure 8:
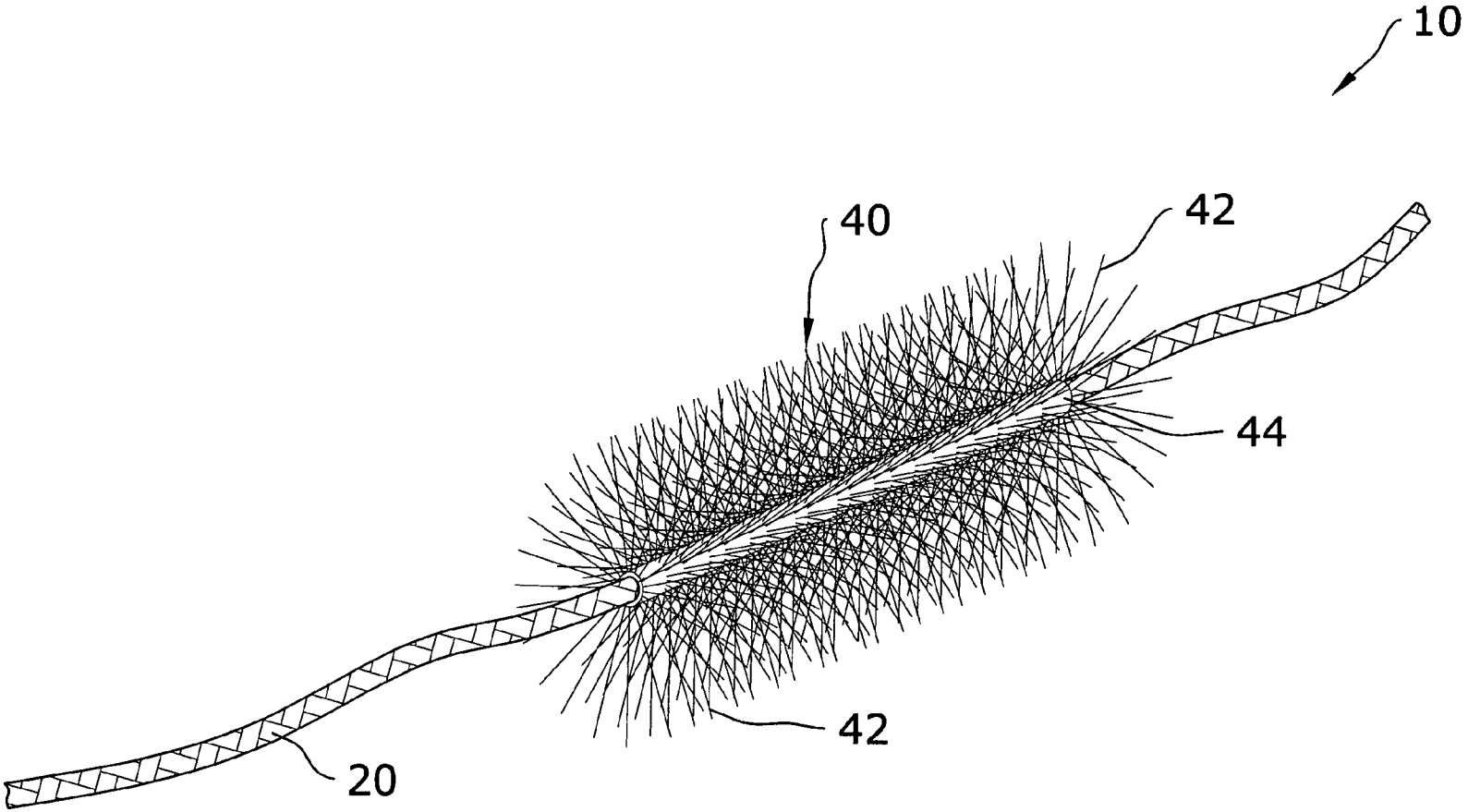
FIG. 8 is an upper perspective view of an alternative embodiment of the present invention utilizing a brush.
Figure 9:
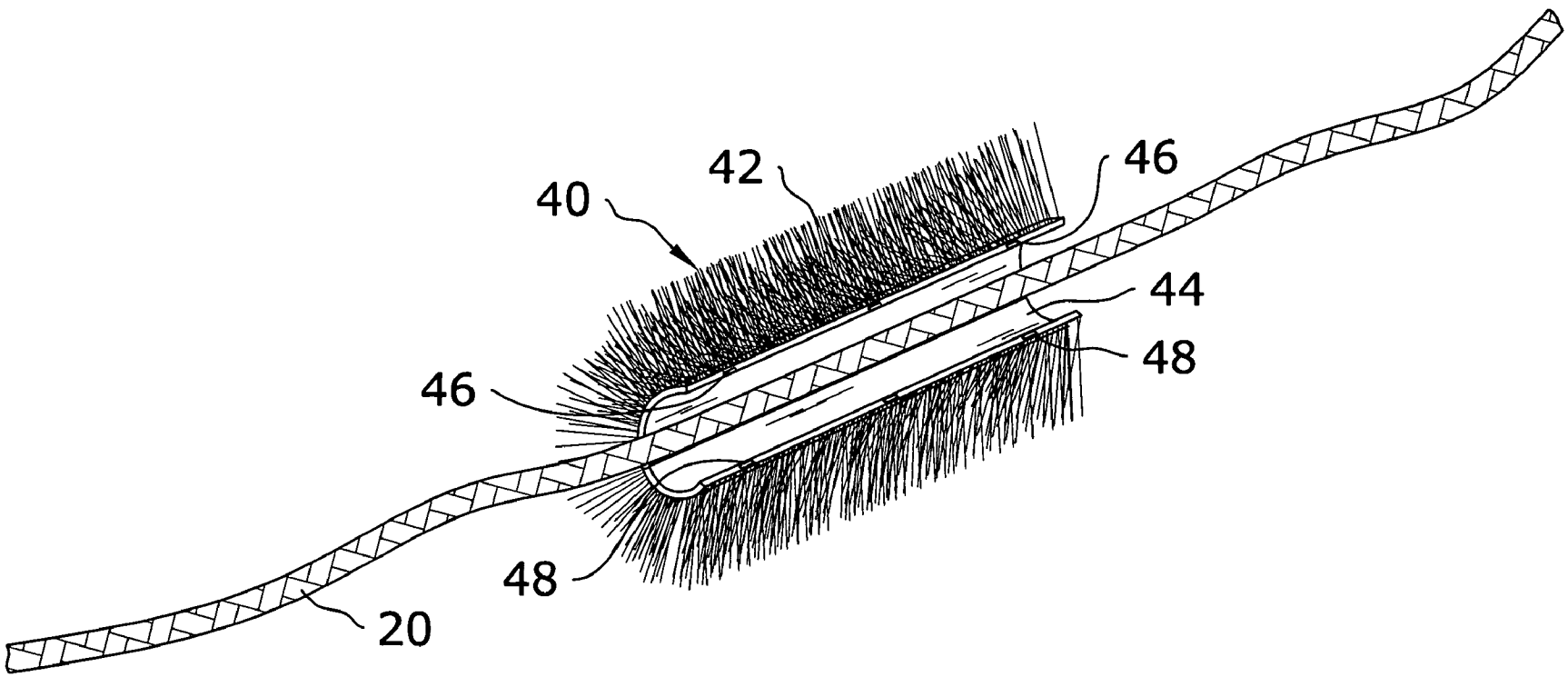
FIG. 9 is an upper perspective view of the alternative embodiment with the brush partially removed.

In an alternative embodiment shown in FIGS. 8 through 10 of the drawings, a brush 40 is attached to the cord 20 between the first end and the second end of the cord 20. The brush 40 is preferably removably attached to the cord 20, however the brush 40 may be non-removably attached to the cord 20. In addition, it is preferable that more than one brush 40 is attached to the cord 20 at various locations.

As shown in FIG. 9 of the drawings, the brush 40 includes a plurality of bristles 42 attached to a clamp 44. The plurality of bristles 42 extend outwardly and radially from the clamp 44 as shown in FIGS. 8 and 9 of the drawings. The clamp 44 is removably attachable to the cord 20 as further shown in FIG. 9 of the drawings.

FIG. 9 illustrates the clamp 44 having a cuff shaped structure where the distal ends are attached to one another. The clamp 44 includes at least one first fastener 46 attached to a first side of the clamp 44 and at least one second fastener 48 attached to a second side of the clamp 44 in opposition to one another. The first fastener 46 and the second fastener 48 are catchably attachable to one another thereby allowing securing of the clamp 44 about the cord 20 as illustrated in FIG. 8 of the drawings.

E. Cleaning Member

FIGS. 15 through 20 illustrate two alternative embodiments comprised of a cleaning member 40, 60 having at least one spiral groove 62. The spiral groove 62 is formed for securely receiving a portion of the cord 20. The spiral groove 62 may have various pitches.

Figure 15:
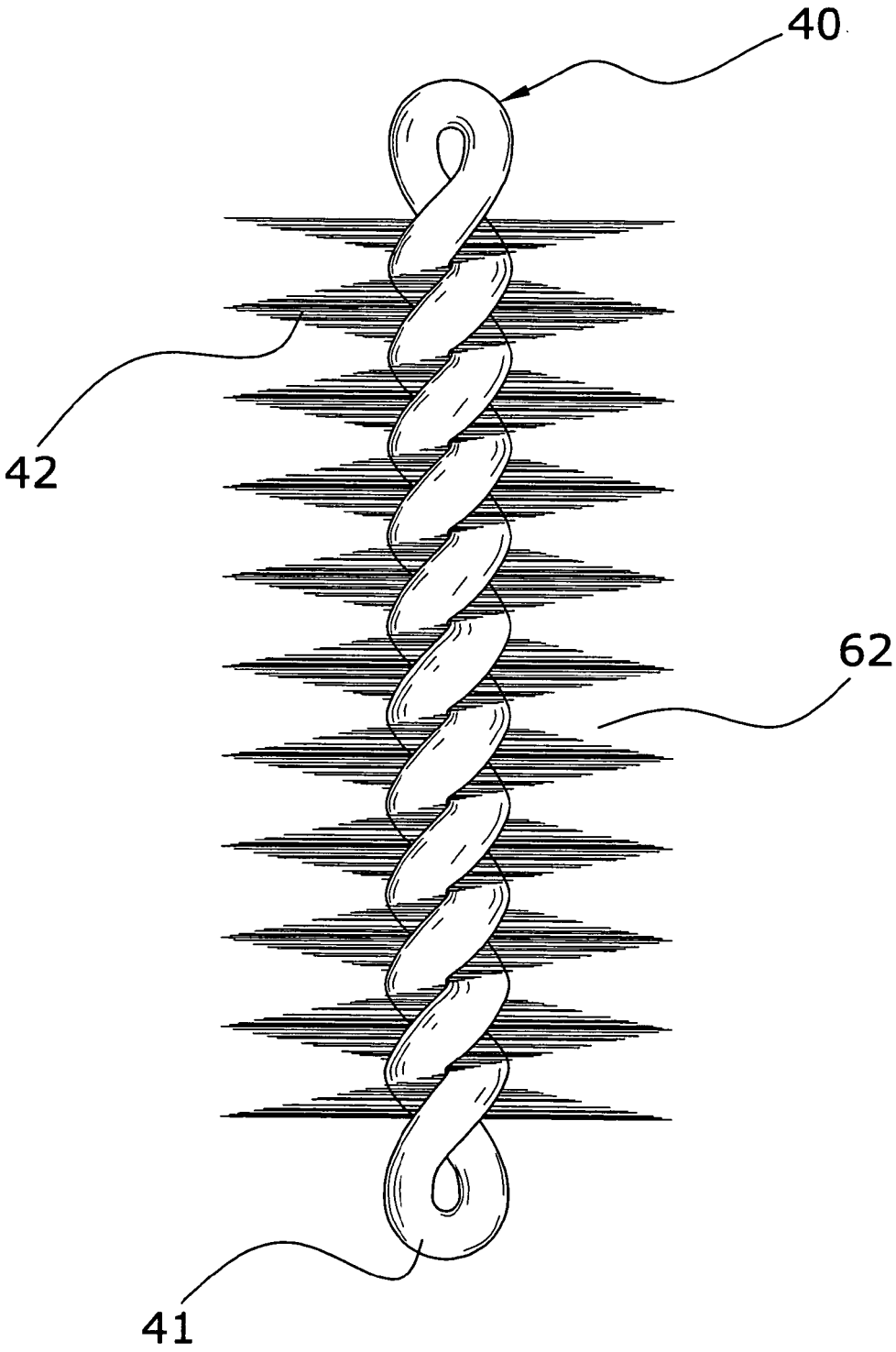
FIG. 15 is a top view of a brush having spiral bristles suitable for use in a second alternative embodiment of the present invention.

FIGS. 15 through 17*b* of the drawings illustrate the cleaning member being comprised of a brush 40 having spiral bristles 42 extending from a core 41. The spiral bristles 42 define a spiral groove 62 for receiving a portion of the length of cord 20. The bristles 42 may be comprised of various types of materials commonly utilized to construct brushes (e.g. plastic, metal, fiber). The core 41 may be comprised of various structures capable of supporting the bristles 42 in a spiral patter such as but not limited to a twisted length of metal wire. The core 41 preferably has looped or rounded distal ends to prevent damage to the bore 16 during cleaning as best illustrated in FIG. 15 of the drawings.

Figure 18:
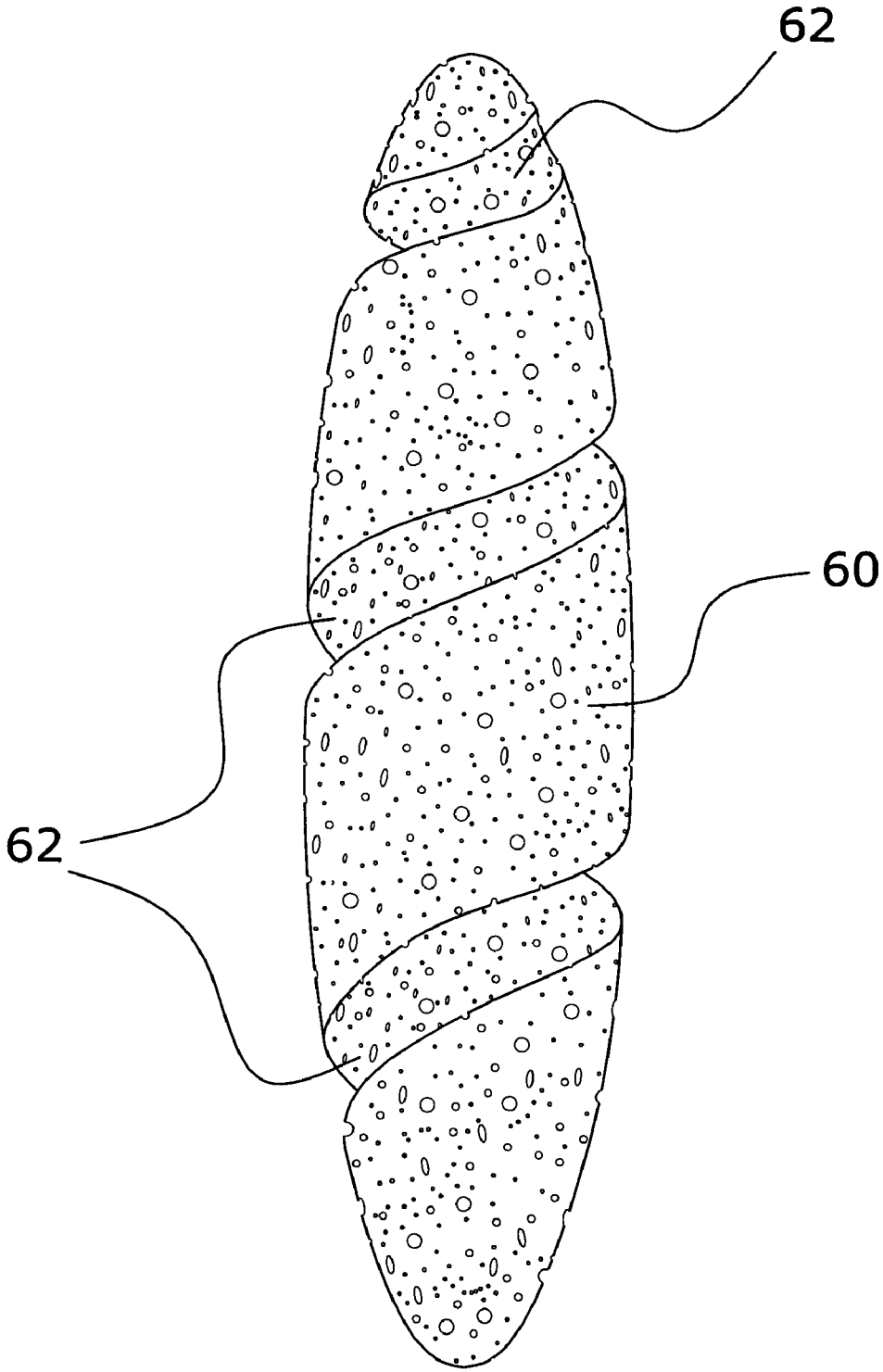
FIG. 18 is a side view of a third alternative embodiment comprised of a sponge with a spiral groove.
Figure 19:
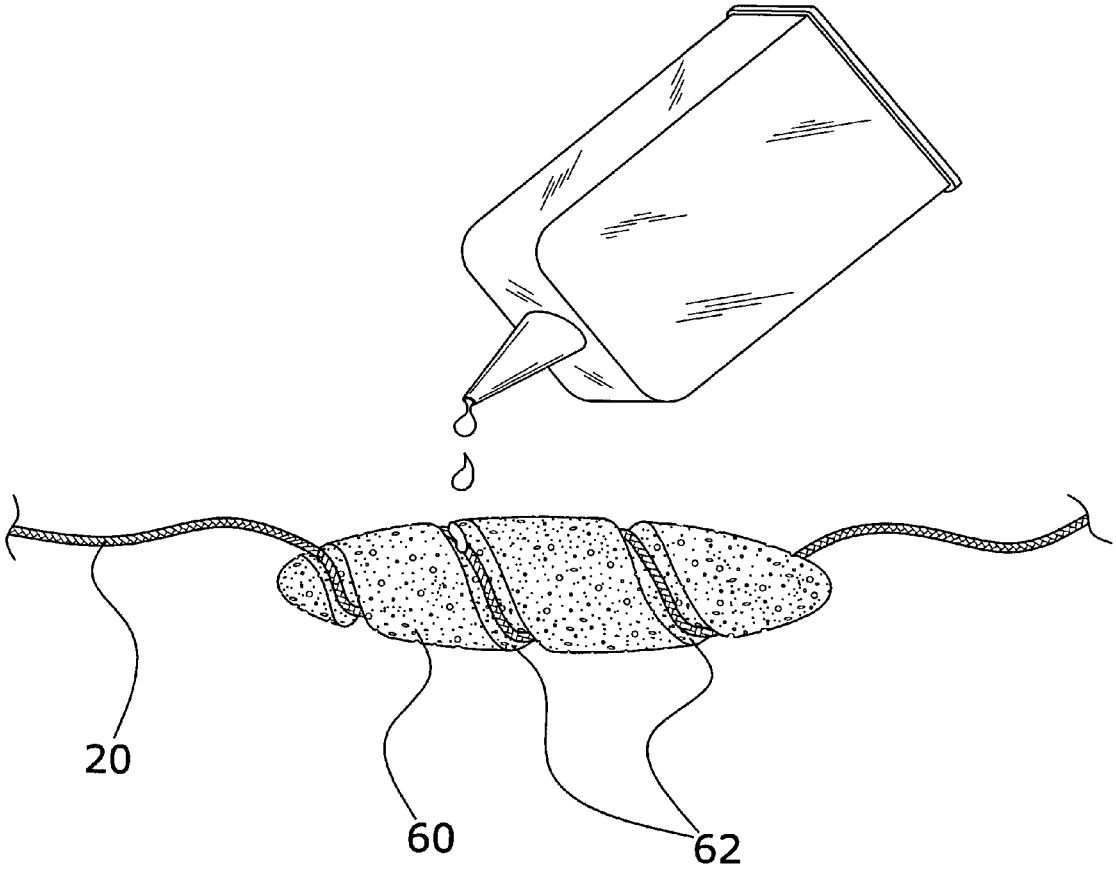
FIG. 19 is a side view of the third alternative embodiment with a length of cord positioned within the spiral groove of the sponge.
Figure 20:
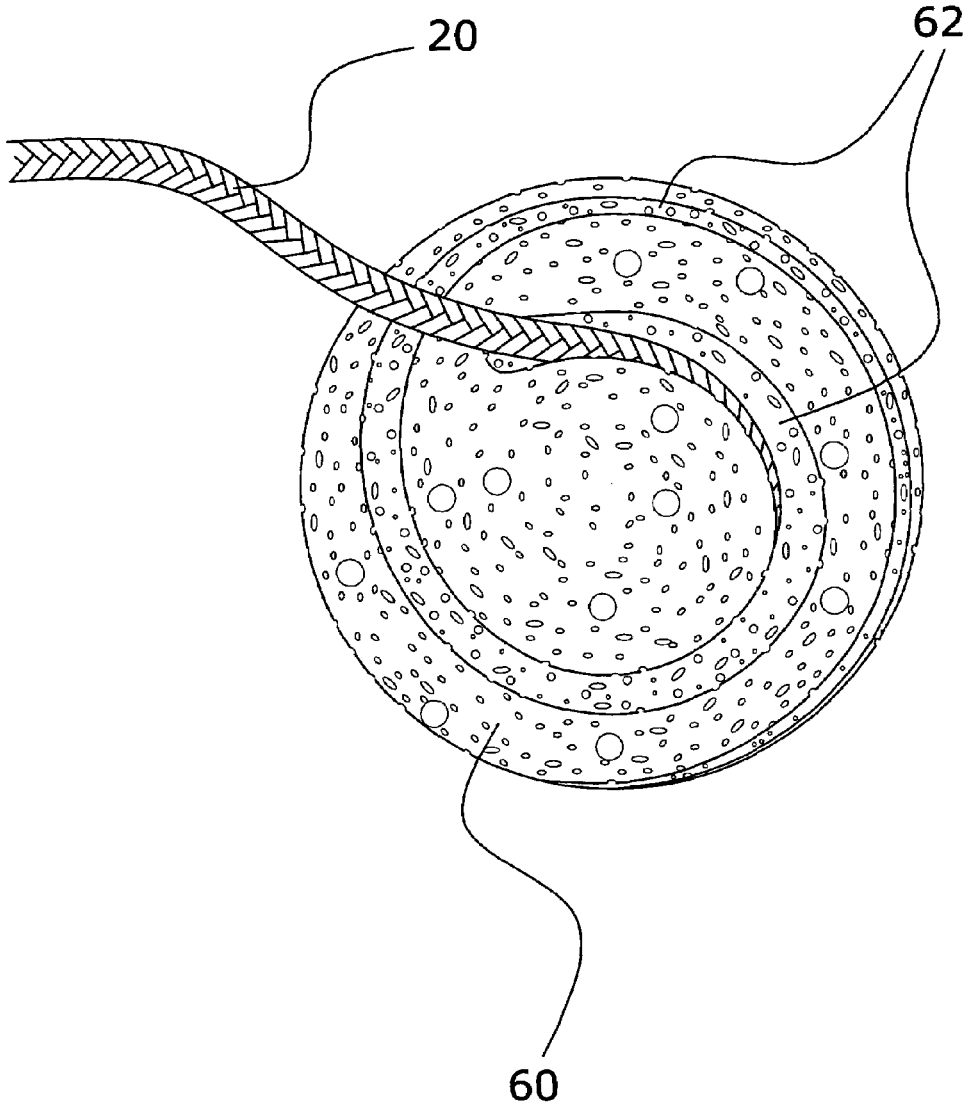
FIG. 20 is an end view of the third alternative embodiment with the cord wrapped around the sponge.

FIGS. 18 through 20 illustrate the cleaning member being comprised of a sponge 60 having a spiral groove 62 extending within. The sponge 60 may be comprised of various types of porous and absorbent materials (e.g. plastics, rubber, cellulose, numerous aquatic invertebrate animals of the phylum Porifera, or other materials). The sponge 60 preferably has a circular cross sectional shape as best illustrated in FIG. 20 of the drawings. The sponge 60 preferably also has tapering opposing ends as best illustrated in FIG. 18 of the drawings. The tapering ends of the sponge 60 assist in the guiding and cleaning of the bore 16.

Figure 21:
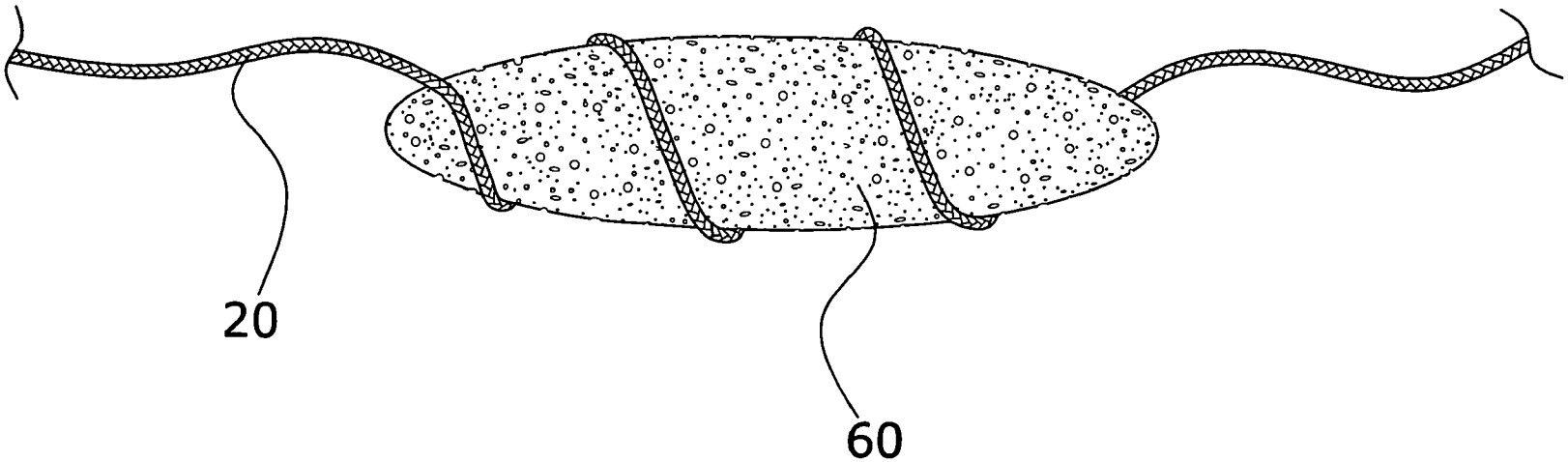
FIG. 21 is a side view of the sponge without a groove with a length of cord surrounding the sponge.

FIG. 21 illustrates another embodiment of the sponge 60 without the usage of spiral groove 62 or any other type of groove structure. The length of cord 20 is wrapped around the sponge 60 in a spiral manner thereby frictionally engaging the sponge 60. The brush 40 may also be comprised of bristles 42 that are not in a spiral pattern with the cord 20 wrapped within the bristles 42. In addition, the cleaning member may be comprised of a swab or other similar structure where the cord 20 may be wrapped about the same.

F. Operation of Invention

Figure 3:
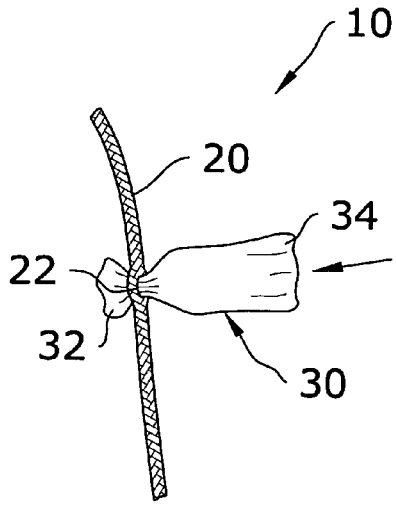
FIG. 3 is an upper perspective view of the swab partially inserted into the receiver opening in the cord.
Figure 16:
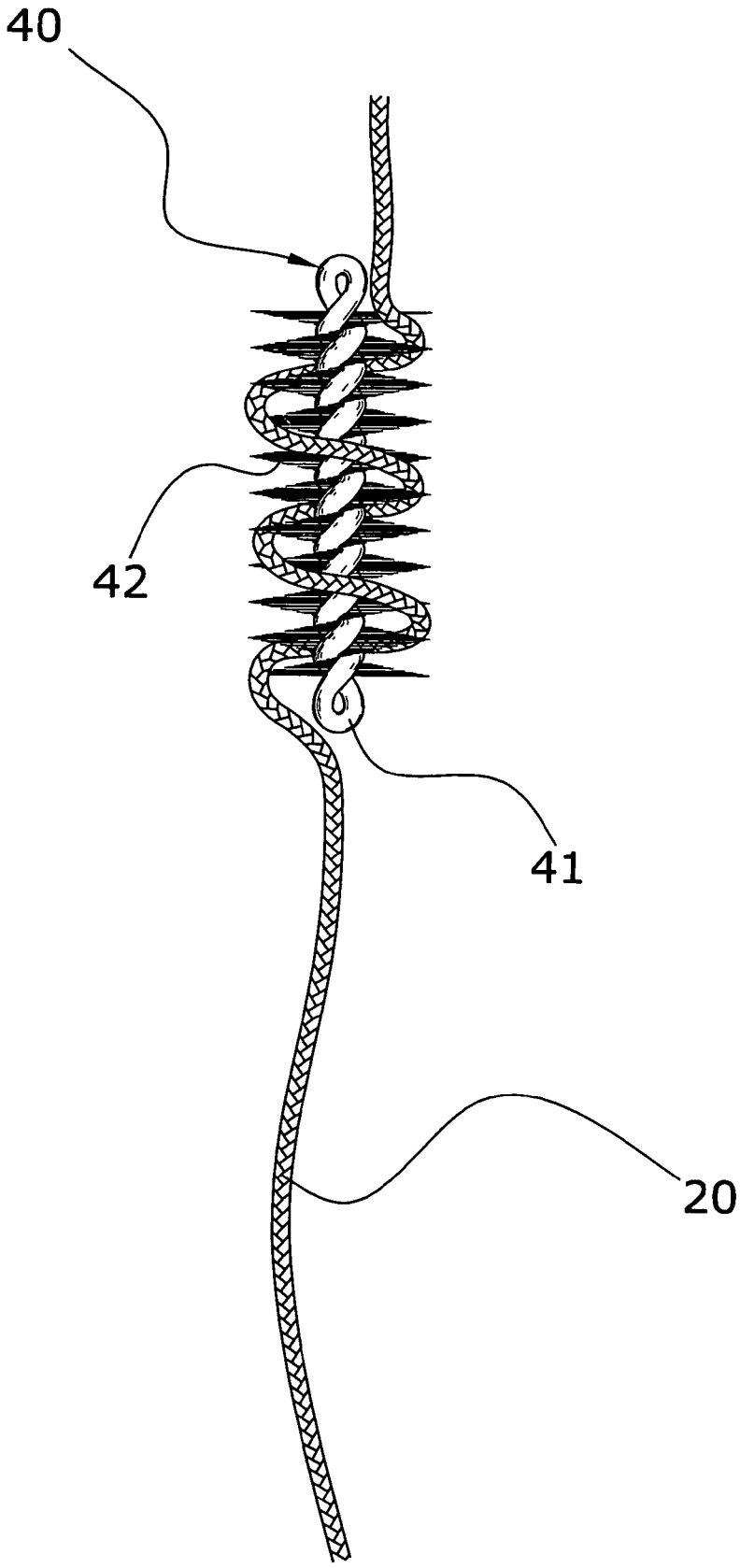
FIG. 16 is a top view of the second alternative embodiment with a length of cord extending within the spiral channels of the brush.
Figure 17A:
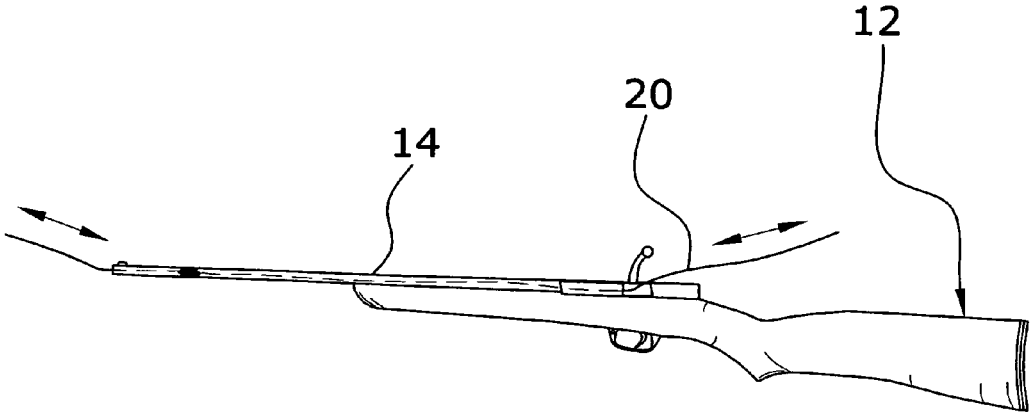
FIG. 17*a* is a side view of the second alternative embodiment being utilized to clean a gun bore.
Figure 17B:
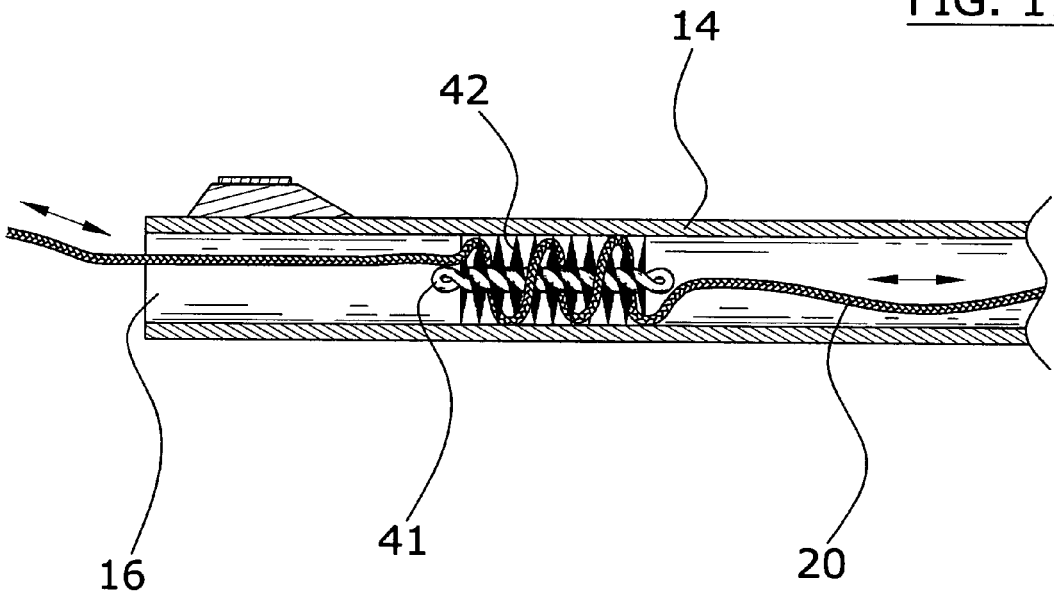
FIG. 17*b* is a side cutaway view of the second alternative embodiment being utilized to clean the gun bore.

In use, the user inserts one or more swabs 30 into the receiver openings 22 of the cord 20 as illustrated in FIGS. 2 through 4 of the drawings. Alternatively, at least one brush 40 or sponge 60 is attached to the cord 20 as shown in FIGS. 9, 16 and 19 of the drawings. The user may apply cleaning solvent, oil or other substance prior to or after assembly within the cord 20. The user then extends a first end of the cord 20 into the bore 16 until the first end of the cord 20 extends outside of a first opening of the barrel 14 with the second end of the cord 20 still extending outside of a second opening of the barrel 14 as shown in FIG. 6 of the drawings. The cord 20 is then manually reciprocated creating a cleaning action within the bore 16 with the swabs 30 (or the brush 40 or the sponge 60) engaging the inner surface of the bore 16 for cleaning and drying. Alternatively, as shown in FIG. 11 of the drawings, the cord 20 is drawn through the bore 16 in a single direction if the cord 20 is tied into a loop structure. When the user is finished cleaning the bore 16 of the gun 12, the cord 20 is removed from the bore 16. The user may sever any worn, contaminated or otherwise unusable portion of the cord 20 to allow for usage of the remaining portion of the cord 20. Any contaminated brushes 40 or sponges 60 may be removed from the cord 20 for cleaning or discarding. The cord 20 may also be conveniently stored in various compact locations.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A gun bore cleaning apparatus that is extendable within a bore of a gun for cleaning the bore of the gun, comprising:

a cleaning member having a spiral groove; and a length of cord having a first end and a second end, wherein said length of cord is positioned within said spiral groove for removably attaching said cleaning member to said length of cord.

2. The gun bore cleaning apparatus of claim 1, wherein said cleaning member is comprised of a brush having spiral bristles.

3. The gun bore cleaning apparatus of claim 2, wherein said spiral bristles define a spiral groove for receiving a portion of said length of cord.

4. The gun bore cleaning apparatus of claim 1, wherein said cleaning member is comprised of a sponge having a spiral groove.

5. The gun bore cleaning apparatus of claim 1, wherein said cleaning member has a circular cross sectional shape.

6. The gun bore cleaning apparatus of claim 1, wherein said cleaning member has tapering opposing ends.

7. A method of cleaning a bore of a gun, said method comprising the steps of:

providing a cord having a first end and a second end;

providing a cleaning member having a spiral groove;

inserting a portion of said cord within said spiral groove;

extending said cord into a bore of a barrel of a gun until said first end of said cord extends outside of a first opening of said barrel and wherein said second end of said cord extends outside of a second opening of said barrel; and reciprocating said cord for cleaning said bore.

8. The method of cleaning a bore of a gun of claim 7, including the step of removing said cord from said bore.

9. The method of cleaning a bore of a gun of claim 7, including the step of applying a cleaning solvent or an oil to said cleaning member.

10. The method of cleaning a bore of a gun of claim 7, including the step of severing a portion of said cord that is contaminated.

11. The method of cleaning a bore of a gun of claim 7, including the step of attaching said first end of said cord to said second end of said cord.

* * * * *